US011769482B2

(12) United States Patent
Wang et al.

(10) Patent No.: US 11,769,482 B2
(45) Date of Patent: Sep. 26, 2023

(54) METHOD AND APPARATUS OF SYNTHESIZING SPEECH, METHOD AND APPARATUS OF TRAINING SPEECH SYNTHESIS MODEL, ELECTRONIC DEVICE, AND STORAGE MEDIUM

(71) Applicant: Beijing Baidu Netcom Science Technology Co., Ltd., Beijing (CN)

(72) Inventors: Wenfu Wang, Beijing (CN); Tao Sun, Beijing (CN); Xilei Wang, Beijing (CN); Junteng Zhang, Beijing (CN); Zhengkun Gao, Beijing (CN); Lei Jia, Beijing (CN)

(73) Assignee: Beijing Baidu Netcom Science Technology Co., Ltd., Beijing (CN)

( * ) Notice: Subject to any disclaimer, the term of this patent is extended or adjusted under 35 U.S.C. 154(b) by 76 days.

(21) Appl. No.: 17/489,616

(22) Filed: Sep. 29, 2021

(65) Prior Publication Data

US 2022/0020356 A1 Jan. 20, 2022

(30) Foreign Application Priority Data

Nov. 11, 2020 (CN) ..... 202011253104.5

(51) Int. Cl.
*G10L 13/10* (2013.01)
*G10L 25/30* (2013.01)

(52) U.S. Cl.
CPC ..... *G10L 13/10* (2013.01); *G10L 25/30* (2013.01)

(58) Field of Classification Search
CPC ..... G10L 13/10; G10L 25/30
(Continued)

(56) References Cited

U.S. PATENT DOCUMENTS 10,741,169 B1 * 8/2020 Trueba ..... G10L 13/10
2020/0234693 A1 * 7/2020 Sung ..... G10L 15/22
(Continued)

FOREIGN PATENT DOCUMENTS

JP 2018-146803 9/2018
KR 10-2057927 12/2019

OTHER PUBLICATIONS

P. Nagy, C. Zainkó and G. Németh, "Synthesis of speaking styles with corpus- and HMM-based approaches," 2015 6th IEEE International Conference on Cognitive Infocommunications (CogInfoCom), Gyor, Hungary, 2015, pp. 195-200, doi: 10.1109/CogInfoCom.2015.7390589. (Year: 2015).*

(Continued)

*Primary Examiner* — Bharatkumar S Shah
(74) *Attorney, Agent, or Firm* — Hamre, Schumann, Mueller & Larson, P.C.

(57) ABSTRACT

The present disclosure provides a method and apparatus of synthesizing a speech, a method and apparatus of training a speech synthesis model, an electronic device, and a storage medium. The method of synthesizing a speech includes acquiring a style information of a speech to be synthesized, a tone information of the speech to be synthesized, and a content information of a text to be processed; generating an acoustic feature information of the text to be processed, by using a pre-trained speech synthesis model, based on the style information, the tone information, and the content information of the text to be processed; and synthesizing the speech for the text to be processed, based on the acoustic feature information of the text to be processed.

10 Claims, 9 Drawing Sheets

(58) Field of Classification Search
USPC ..... 704/259
See application file for complete search history.

(56) References Cited

U.S. PATENT DOCUMENTS

2020/0342852 A1 10/2020 Kim et al.
2021/0097976 A1* 4/2021 Chicote ..... G10L 13/033

OTHER PUBLICATIONS

P. Nagy, C. Zainké and G. Németh, "Synthesis of speaking styles with corous- and HMM-based approaches," 2015 6th IEEE International Conference on Cognitive Infocommunications (CogInfoCom), Gyor, Hungary, 2015, pp. 195-200, doi: 10.1109/ Cogl nfoCom. 2015.7390589. (Year: 2015) (Year: 2015).*
Korean office action, issued in the corresponding Korean patent application No. 10-2021-0117980, dated Mar. 20, 2023, 8 pages with machine translation.
Pan et al., "Unified Sequence-To-Sequence Front-End Model for Mandarin Text-To-Speech Synthesis", Bytedance AI-Lab, Shanghai Jiaotong University, ICASSP 2020, pp. 6689-6693.

* cited by examiner

METHOD AND APPARATUS OF SYNTHESIZING SPEECH, METHOD AND APPARATUS OF TRAINING SPEECH SYNTHESIS MODEL, ELECTRONIC DEVICE, AND STORAGE MEDIUM

CROSS-REFERENCE TO RELATED APPLICATION(S)

This application claims priority to the Chinese Patent Application No. 202011253104.5, filed on Nov. 11, 2020, which is incorporated herein by reference in its entirety.

TECHNICAL FIELD

The present disclosure relates to a field of a computer technology, and in particular to a field of an artificial intelligence technology such as an intelligent speech and deep learning technology, and more specifically to a method and apparatus of synthesizing a speech, a method and apparatus of training a speech synthesis model, an electronic device, and a storage medium.

BACKGROUND

Speech synthesis is also known as Text-to-Speech (TTS) and refers to a process of converting text information into speech information with a good sound quality and a natural fluency through a computer. The speech synthesis technology is one of core technologies of an intelligent speech interaction technology.

In recent years, with a development of the deep learning technology and its wide application in the field of speech synthesis, the sound quality and the natural fluency of the speech synthesis have been improved unprecedentedly. The current speech synthesis model is mainly used to perform the speech synthesis of a single speaker (that is, a single tone) and a single style. In order to perform multi-style and multi-tone synthesis, training data in various styles recorded by each speaker may be acquired to train the speech synthesis model.

SUMMARY

The present disclosure provides a method and apparatus of synthesizing a speech, a method and apparatus of training a speech synthesis model, an electronic device, and a storage medium.

According to an aspect of the present disclosure, a method of synthesizing a speech is provided, and the method includes: acquiring a style information of a speech to be synthesized, a tone information of the speech to be synthesized, and a content information of a text to be processed; generating an acoustic feature information of the text to be processed, by using a pre-trained speech synthesis model, based on the style information, the tone information, and the content information of the text to be processed; and synthesizing the speech for the text to be processed, based on the acoustic feature information of the text to be processed.

According to another aspect of the present disclosure, a method of training a speech synthesis model is provided, and the method includes: acquiring a plurality of training data, wherein each of the plurality of training data contains a training style information of a speech to be synthesized, a training tone information of the speech to be synthesized, a content information of a training text, a style feature information using a training style corresponding to the training style information to describe the content information of the training text, and a target acoustic feature information using the training style corresponding to the training style information and a training tone corresponding to the training tone information to describe the content information of the training text; and training the speech synthesis model by using the plurality of training data.

According to yet another aspect of the present disclosure, an electronic device is provided, and the electronic device includes: at least one processor; and a memory in communication with the at least one processor; wherein the memory stores instructions executable by the at least one processor, and the instructions, when executed by the at least one processor, cause the at least one processor to implement the method described above.

According to yet another aspect of the present disclosure, a non-transitory computer-readable storage medium having computer instructions stored thereon is provided, wherein the computer instructions, when executed, cause a computer to implement the method described above.

It should be understood that the content described in the summary is not intended to limit the critical or important features of the embodiments of the present disclosure, nor is it intended to limit the scope of the present disclosure. Other features of the present disclosure will be easily understood by the following description.

BRIEF DESCRIPTION OF THE DRAWINGS

The accompanying drawings are used to better understand the present disclosure and do not constitute a limitation to the present disclosure, in which.

DETAILED DESCRIPTION

The following describes exemplary embodiments of the present disclosure with reference to the accompanying drawings, which include various details of the embodiments of the present disclosure to facilitate understanding, and should be considered as merely exemplary. Therefore, those ordinary skilled in the art should realize that various changes and modifications can be made to the embodiments described herein without departing from the scope and spirit of the present disclosure. Likewise, for clarity and conciseness, descriptions of well-known functions and structures are omitted in the following description.

Figure 1:
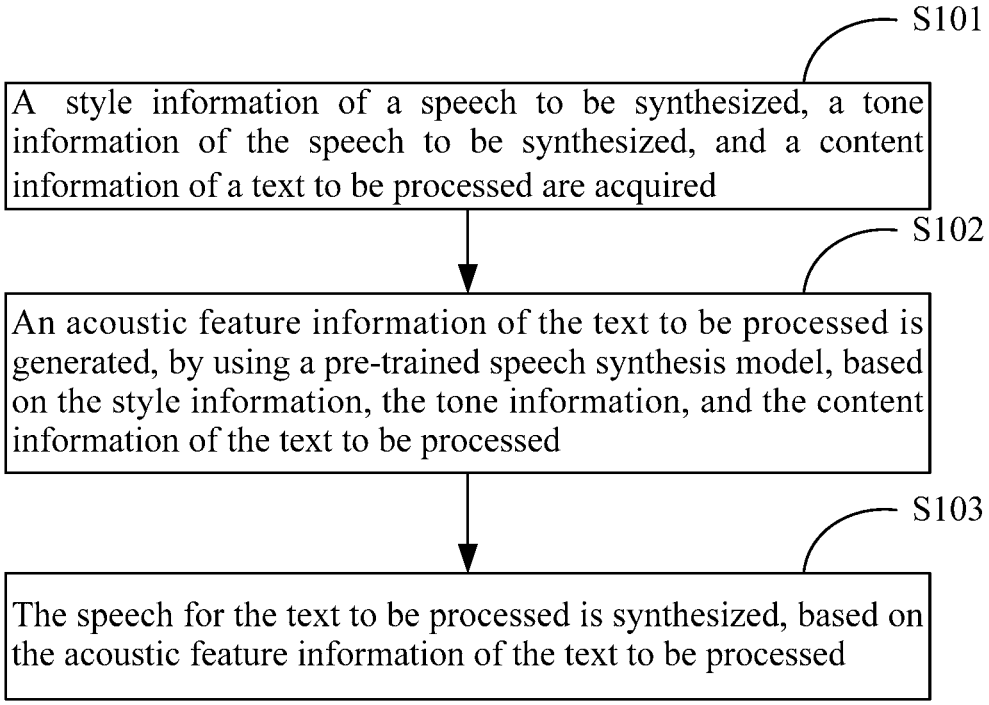
FIG. 1 is a schematic diagram according to some embodiments of the present disclosure.

FIG. 1 is a schematic diagram according to some embodiments of the present disclosure. As shown in FIG. 1, the embodiments provide a method of synthesizing a speech, and the method may specifically include the following steps.

In S101, a style information of a speech to be synthesized, a tone information of the speech to be synthesized, and a content information of a text to be processed are acquired.

In S102, an acoustic feature information of the text to be processed is generated, by using a pre-trained speech synthesis model, based on the style information, the tone information, and the content information of the text to be processed.

In S103, the speech for the text to be processed is synthesized, based on the acoustic feature information of the text to be processed.

The execution entity of the method of synthesizing a speech in the embodiments is an apparatus of synthesizing a speech, and the apparatus may be an electronic entity. Alternatively, the execution entity may be an application integrated with software. When in use, the speech for the text to be processed may be synthesized based on the style information of the speech to be synthesized, the tone information of the speech to be synthesized, and the content information of the text to be processed.

In the embodiments, the style information of the speech to be synthesized and the tone information of the speech to be synthesized should be a style information and a tone information in a training data set used for training the speech synthesis model, otherwise the speech may not be synthesized.

In the embodiments, the style information of the speech to be synthesized may be a style identifier of the speech to be synthesized, such as a style ID, and the style ID may be a style ID trained in a training data set. Alternatively, the style information may also be other information of a style extracted from a speech described in the style. However, in practice, when in use, the speech described in the style may be expressed in a form of a Mel spectrum sequence. The tone information of the embodiments may be extracted based on the speech described by the tone, and the tone information may be expressed in the form of the Mel spectrum sequence.

The style information of the embodiments is used to define a style for describing a speech, such as humorous, joy, sad, traditional, and so on. The tone information of the embodiments is used to define a tone for describing a speech, such as a tone of a star A, a tone of an announcer B, a tone of a cartoon animal C, and so on.

The content information of the text to be processed in the embodiments is in a text form. Optionally, before step S101, the method may further include: pre-processing the text to be processed, and acquiring a content information of the text to be processed, such as a sequence of phonemes. For example, if the text to be processed is Chinese, the content information of the text to be processed may be a sequence of tuned phonemes of the text to be processed. As the pronunciation of Chinese text carries tones, for Chinese, the sequence of tuned phonemes should be acquired by pre-processing the text. For other languages, the sequence of phonemes may be acquired by preprocessing a corresponding text. For example, when the text to be processed is Chinese, the phoneme may be a syllable in Chinese pinyin, such as an initial or a final of a Chinese pinyin.

In the embodiments, the style information, the tone information, and the content information of the text to be processed may be input into the speech synthesis model. The acoustic feature information of the text to be processed may be generated by using the speech synthesis model based on the style information, the tone information, and the content information of the text to be processed. The speech synthesis model in the embodiments may be implemented by using a Tacotron structure. Finally, a neural vocoder (WaveRNN) model may be used to synthesize a speech for the text to be processed based on the acoustic feature information of the text to be processed.

In the related art, only a single tone or a single style of the speech may be performed. By using the technical solution of the embodiments, when synthesizing the speech based on the style information, the tone information, and the content information of the text to be processed, the style and the tone may be input as desired, and the text to be processed may also be in any language. Thus the technical solution of the embodiments may perform a cross-language, cross-style, and cross-tone speech synthesis, and may be not limited to the single tone or single style speech synthesis.

According to the method of synthesizing a speech in the embodiments, the style information of the speech to be synthesized, the tone information of the speech to be synthesized, and the content information of the text to be processed are acquired. The acoustic feature information of the text to be processed is generated by using the pre-trained speech synthesis model based on the style information, the tone information, and the content information of the text to be processed. The speech for the text to be processed is synthesized based on the acoustic feature information of the text to be processed. In this manner, a cross-language, cross-style, and cross-tone speech synthesis may be performed, which may enrich a diversity of speech synthesis and improve the user's experience.

Figure 2:
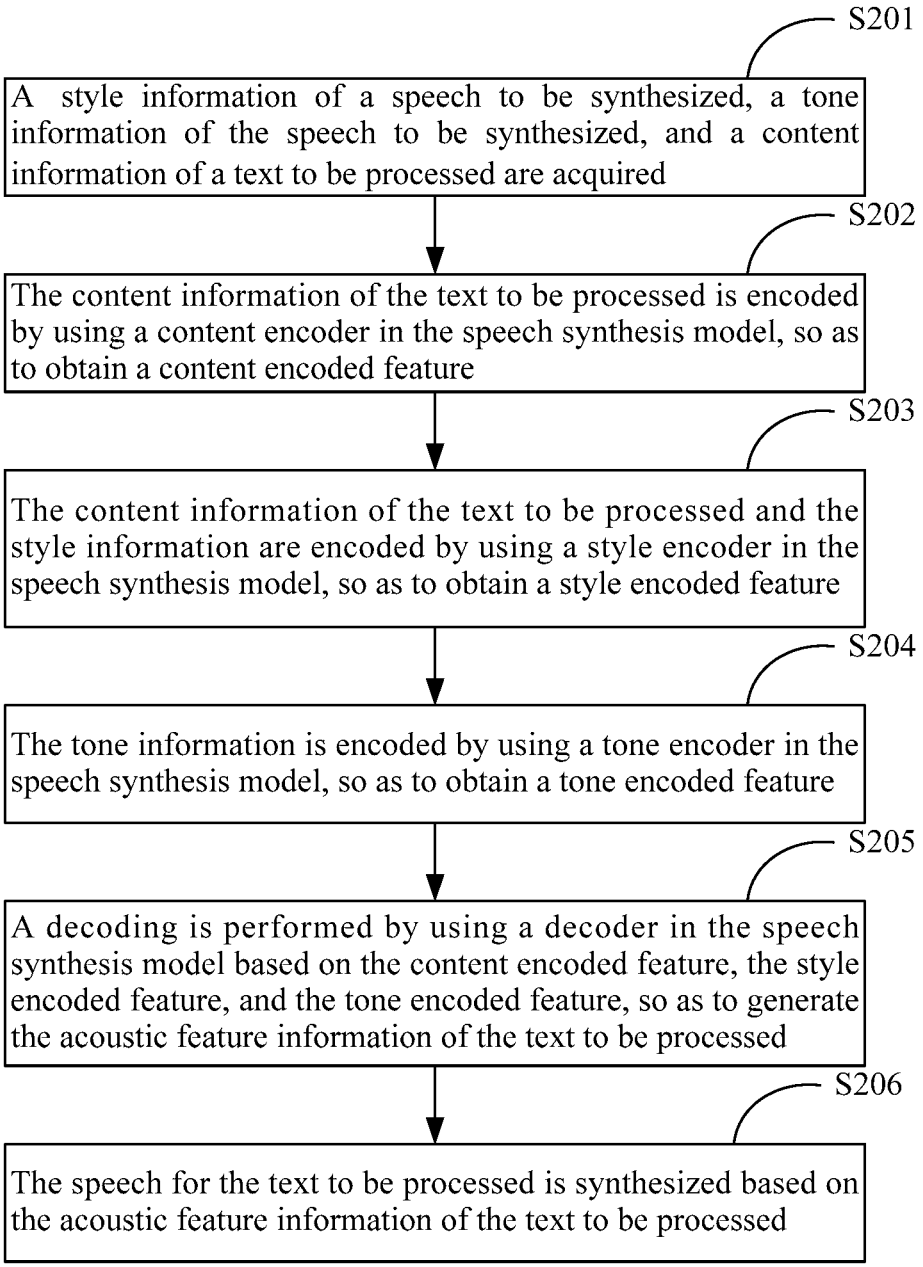
FIG. 2 is a schematic diagram according to some embodiments of the present disclosure.

FIG. 2 is a schematic diagram according to some embodiments of the present disclosure. As shown in FIG. 2, a method of synthesizing a speech in the embodiments describe the technical solution of the present disclosure in more detail on the basis of the technical solution of the embodiments shown in FIG. 1. As shown in FIG. 2, the method of synthesizing a speech in the embodiments may specifically include the following steps.

In S201, a style information of a speech to be synthesized, a tone information of the speech to be synthesized, and a content information of a text to be processed are acquired.

With reference to the related records of the embodiments shown in FIG. 1, the tone information of the speech to be synthesized may be a Mel spectrum sequence of the text to be processed described by the tone, and the content information of the text to be processed may be the sequence of phonemes of the text to be processed obtained by pre-processing the text to be processed.

For example, a process of acquiring the style information in the embodiments may include any of the following methods.

(1) A description information of an input style of a user is acquired; and a style identifier, from a preset style table, corresponding to the input style according to the description information of the input style is determined as the style information of the speech to be synthesized.

For example, a description information of an input style may be humorous, funny, sad, traditional, etc. In the embodiments, a style table is preset, and style identifiers corresponding to various types of the description information of the style may be recorded in the style table. Moreover, these style identifiers have been trained in a previous process of training the speech synthesis model using the training data set. Thus, the style identifiers may be used as the style information of the speech to be synthesized.

(2) An audio information described in an input style is acquired; and information of the input style is extracted from the audio information, as the style information of the speech to be synthesized.

In the embodiments, the style information may be extracted from the audio information described in the input style, and the audio information may be in the form of the Mel spectrum sequence. Further optionally, in the embodiments, a style extraction model may also be pre-trained, and when the style extraction model is used, a Mel spectrum sequence extracted from an audio information described in a certain style is input, and a corresponding style in the audio information is output. During training, the style extraction model may use countless training data, a training style in each training data, and a training Mel spectrum sequence carrying the training style in each training data. Countless training data and a supervised training method are used to train the style extraction model.

In addition, it should be noted that, the tone information in the embodiments may also be extracted from the audio information described by the tone corresponding to the tone information. The tone information may be in the form of the Mel spectrum sequence, or it may be referred to as a tone Mel spectrum sequence. For example, when synthesizing a speech, for convenience, a tone Mel spectrum sequence may be directly acquired from the training data set.

It should be noted that in the embodiments, the audio information described by the input style only needs to carry the input style, and content involved in the audio information may be the content information of the text to be processed, or the content involved in the audio information may be irrelevant to the content information of the text to be processed. Similarly, the audio information described by the tone corresponding to the tone information may also include the content information of the text to be processed, or the audio information may be irrelevant the content information of the text to be processed.

In S202, the content information of the text to be processed is encoded by using a content encoder in the speech synthesis model, so as to obtain a content encoded feature.

For example, the content encoder encodes the content information of the text to be processed, so as to generate a corresponding content encoded feature. As the content information of the text to be processed is in the form of the sequence of phonemes, the content encoded feature obtained may also be correspondingly in a form of a sequence, which may be referred to as a content encoded sequence. Each phoneme in the sequence corresponds to an encoded vector. The content encoder determines how to pronounce each phoneme.

In S203, the content information of the text to be processed and the style information are encoded by using a style encoder in the speech synthesis model, so as to obtain a style encoded feature.

The style encoder encodes the content information of the text to be processed, while uses the style information to control an encoding style and generate a corresponding style encoded matrix. Similarly, the style encoded matrix may also be referred to as a style encoded sequence. Each phoneme corresponds to an encoded vector. The style encoder determines a manner of pronouncing each phoneme, that is, determines the style.

In S204, the tone information is encoded by using a tone encoder in the speech synthesis model, so as to obtain a tone encoded feature.

The tone encoder encodes the tone information, and the tone information may be also in the form of the Mel spectrum sequence. That is, the tone encoder may encode the Mel spectrum sequence to generate a corresponding tone vector. The tone encoder determines a tone of the speech to be synthesized, such as tone A, tone B, or tone C.

In S205, a decoding is performed by using a decoder in the speech synthesis model based on the content encoded feature, the style encoded feature, and the tone encoded feature, so as to generate the acoustic feature information of the text to be processed.

Features output by the content encoder, the style encoder and the tone encoder are stitched and input into the decoder, and the acoustic feature information of the text to be processed is generated according to a corresponding combination of the content information, the style information and the tone information. The acoustic feature information may also be referred to as a speech feature sequence of the text to be processed, and it is also in the form of the Mel spectrum sequence.

The above-mentioned steps S202 to S205 are an implementation of step S102 in the embodiments shown in FIG. 1.

Figure 3:
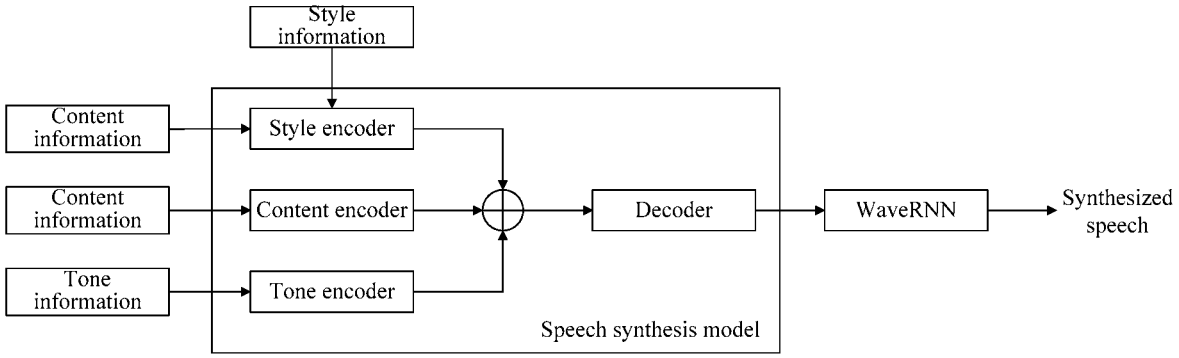
FIG. 3 is a schematic diagram of an application architecture of a speech synthesis model of the embodiments.

FIG. 3 is a schematic diagram of an application architecture of the speech synthesis model of the embodiments. As shown in FIG. 3, the speech synthesis model of the embodiments may include a content encoder, a style encoder, a tone encoder, and a decoder.

Figure 4:
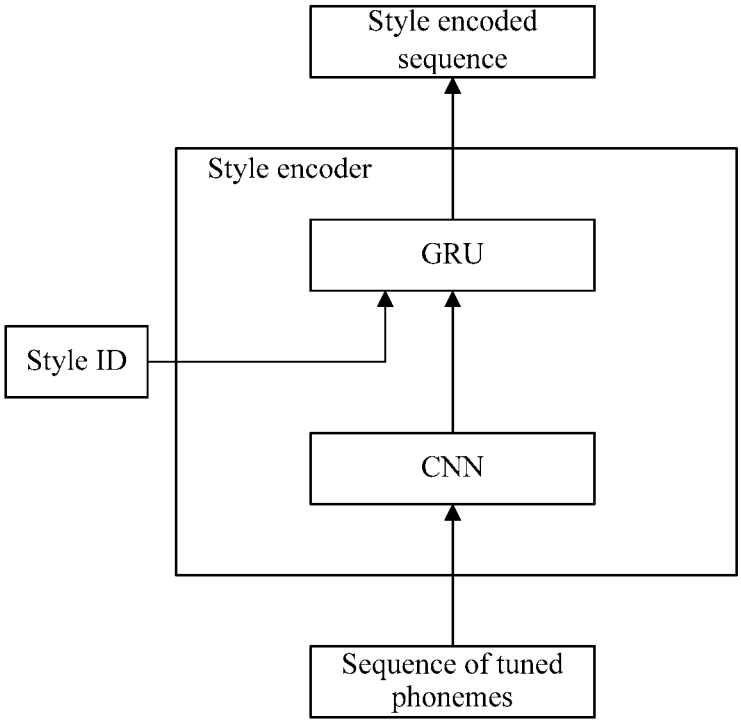
FIG. 4 is a schematic diagram of a style encoder in a speech synthesis model of the embodiments.

The content encoder includes multiple layers of convolutional neural network (CNN) with residual connections and a layer of bidirectional long short-term memory (LSTM). The tone encoder includes multiple layers of CNN and a layer of gated recurrent unit (GRU). The decoder is an autoregressive structure based on an attention mechanism. The style encoder includes multiple layers of CNN and multiple layers of bidirectional GRU. For example, FIG. 4 is a schematic diagram of a style encoder in a speech synthesis model of the embodiments. As shown in FIG. 4, taking the style encoder including N layers of CNN and N layers of GRU as an example, if the content information of the text to be processed (such as the text to be processed) is Chinese, then the content information may be the sequence of tuned phonemes. When the style encoder is encoding, the sequence of tuned phonemes may be directly input into the CNN, and the style information such as the style ID is directly input into the GRU. After the encoding of the style encoder, the style encoded feature may be finally output. As the corresponding input is in the form of the sequence of tuned phonemes, the style encoded feature may also be referred to as the style encoded sequence.

As shown in FIG. 3, compared with the conventional speech synthesis model Tacotron, the content encoder, the style encoder, and the tone encoder in the speech synthesis model of the embodiments are three separate units. The three separate units play different roles in a decoupled state, and each of the three separate units has a corresponding function, which is the key to achieving cross-style, cross-tone, and cross-language synthesis. Therefore, the embodiments are no longer limited to only being able to synthesize a single tone or a single style of the speech, and may perform the cross-language, cross-style, and cross-tone speech synthesis. For example, an English segment X may be broadcasted by singer A in a humorous style, and a Chinese segment Y may be broadcasted by cartoon animal C in a sad style, and so on.

In S206, the speech for the text to be processed is synthesized based on the acoustic feature information of the text to be processed.

In the embodiments, an internal structure of the speech synthesis model is analyzed to more clearly introduce the internal structure of the speech synthesis model. However, in practice, the speech synthesis model is an end-to-end model, which may still perform the decoupling of style, tone, and language, based on the above-mentioned principle, and then perform the cross-style, cross-tone, and cross-language speech synthesis.

In practice, as shown in FIGS. 3 and 4, the text to be processed, the style ID, and the Mel spectrum sequence of the tone are provided, and a text pre-processing module may be used in advance to convert the text to be processed into a corresponding sequence of tuned phonemes, the resulting sequence of tuned phonemes is used as an input of the content encoder and the style encoder in the speech synthesis model, and the style encoder further uses the style ID as an input, so that a content encoded sequence X1 and a style encoded sequence X2 are obtained respectively. Then, according to a tone to be synthesized, a Mel spectrum sequence corresponding to the tone is selected from the training data set as an input of the tone encoder, so as to obtain a tone encoded vector X3. Then X1, X2, and X3 may be stitched in dimension to obtain a sequence Z, and the sequence Z is used as an input of the decoder. The decoder generates a Mel spectrum sequence of the above-mentioned text described by the corresponding style and the corresponding tone according to the sequence Z input, and finally, a corresponding audio is synthesized through the neural vocoder (WaveRNN). It should be noted that the provided text to be processed may be a cross-language text, such as Chinese, English, and a mixture of Chinese and English.

The method of synthesizing a speech in the embodiments may perform the cross-language, cross-style, and cross-tone speech synthesis by adopting the above-mentioned technical solutions, and may enrich the diversity of speech synthesis and reduce the dullness of long-time broadcasting, so as to improve the user's experience. The technical solution of the embodiments may be applied to various speech interaction scenarios, and has a universal promotion.

Figure 5:
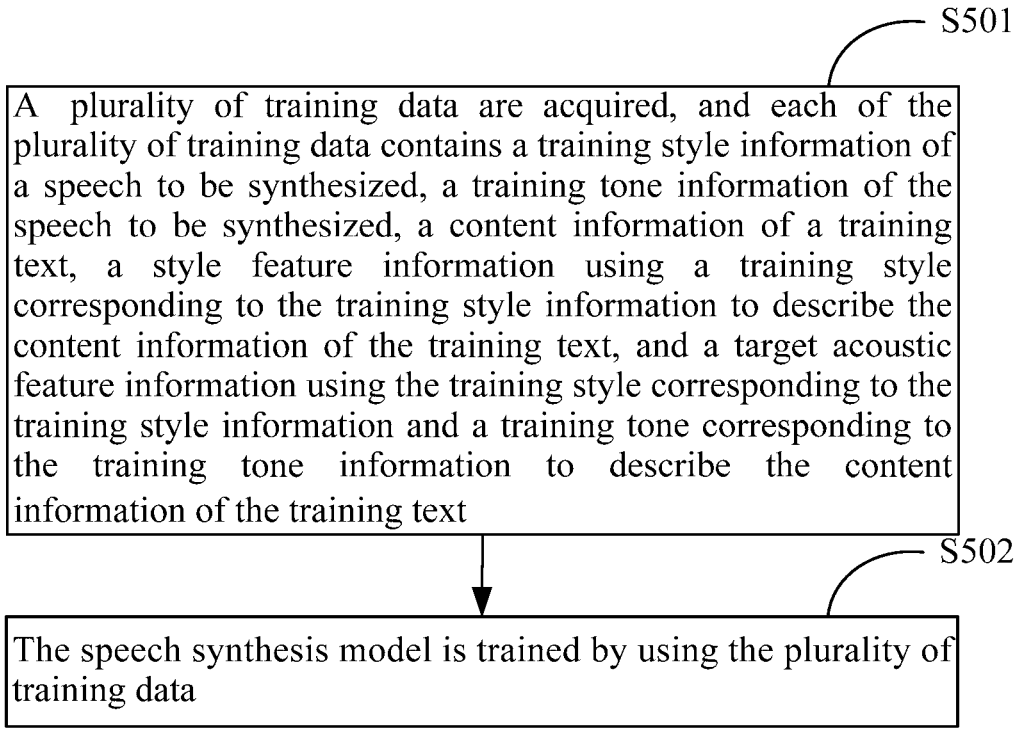
FIG. 5 is a schematic diagram of some embodiments according to the present disclosure.

FIG. 5 is a schematic diagram of some embodiments according to the present disclosure. As shown in FIG. 5, the embodiments provide a method of training a speech synthesis model, and the method may specifically include the following steps.

In S501, a plurality of training data are acquired, and each of the plurality of training data contains a training style information of a speech to be synthesized, a training tone information of the speech to be synthesized, a content information of a training text, a style feature information using a training style corresponding to the training style information to describe the content information of the training text, and a target acoustic feature information using the training style corresponding to the training style information and a training tone corresponding to the training tone information to describe the content information of the training text.

In S502, the speech synthesis model is trained by using the plurality of training data.

The execution entity of the method of training the speech synthesis model in the embodiments is an apparatus of training the speech synthesis model, and the apparatus may be an electronic entity. Alternatively the execution entity may be an application integrated with software, which runs on a computer device when in use to train the speech synthesis model.

In the training of the embodiments, an amount of training data acquired may reach more than one million, so as to train the speech synthesis model more accurately. Each training data may include a training style information of a speech to be synthesized, a training tone information of the speech to be synthesized, and a content information of a training text, which correspond to the style information, the tone information, and the content information in the above-mentioned embodiments respectively. For details, reference may be made to the related records of the above-mentioned embodiments, which will not be repeated here.

In addition, a style feature information using a training style corresponding to the training style information to describe the content information of the training text, and a target acoustic feature information using the training style corresponding to the training style information and a training tone corresponding to the training tone information to describe the content information of the training text in each training data may be used as a reference for supervised training, so that the speech synthesis model may learn more effectively.

The method of training the speech synthesis model in the embodiments may effectively train the speech synthesis model by adopting the above-mentioned technical solution, so that the speech synthesis model learns the process of synthesizing a speech according to the content, the style and the tone, based on the training data, and thus the learned speech synthesis model may enrich the diversity of speech synthesis.

Figure 6:
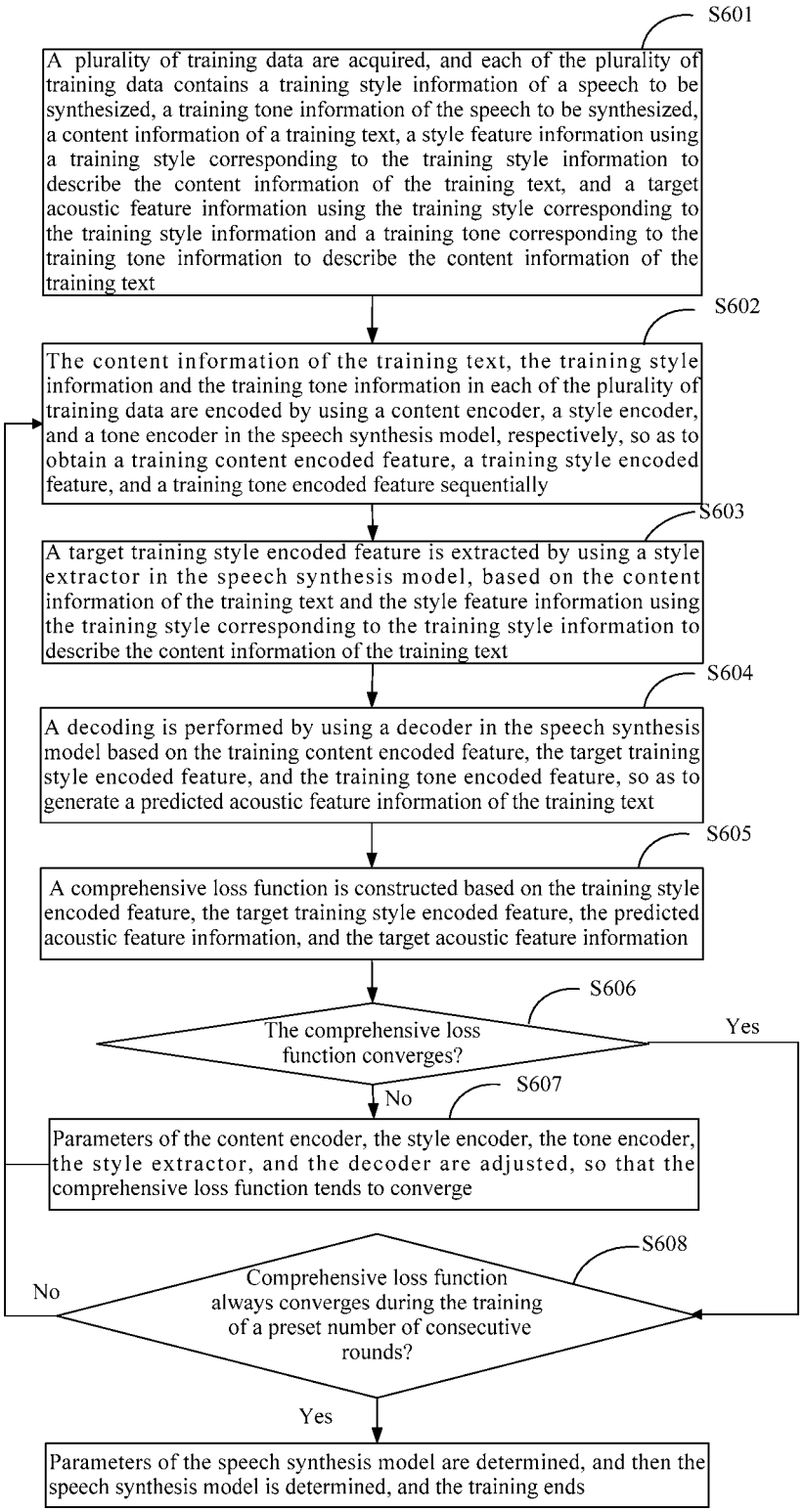
FIG. 6 is a schematic diagram of some embodiments according to the present disclosure.

FIG. 6 is a schematic diagram according to some embodiments of the present disclosure. As shown in FIG. 6, a method of training a speech synthesis model of the embodiments describes the technical solution of the present disclosure in more detail on the basis of the technical solution of the embodiments shown in FIG. 5. As shown in FIG. 6, the method of training the speech synthesis model in the embodiments may specifically include the following steps.

In S601, a plurality of training data are acquired, and each of the plurality of training data contains a training style information of a speech to be synthesized, a training tone information of the speech to be synthesized, a content information of a training text, a style feature information using a training style corresponding to the training style information to describe the content information of the training text, and a target acoustic feature information using the training style corresponding to the training style information and a training tone corresponding to the training tone information to describe the content information of the training text.

In practice, a corresponding speech may be obtained by using the training style and the training tone to describe the content information of the training text, and then a Mel spectrum for the speech obtained may be extracted, so as to obtain a corresponding target acoustic feature information. That is, the target acoustic feature information is also in the form of the Mel spectrum sequence.

In S602, the content information of the training text, the training style information and the training tone information in each of the plurality of training data are encoded by using a content encoder, a style encoder, and a tone encoder in the speech synthesis model, respectively, so as to obtain a training content encoded feature, a training style encoded feature, and a training tone encoded feature sequentially.

Specifically, the content encoder in the speech synthesis model is used to encode the content information of the training text in the training data to obtain the training content encoded feature. The style encoder in the speech synthesis model is used to encode the training style information in the training data and the content information of the training text in the training data to obtain the training style encoded feature. The tone encoder in the speech synthesis model is used to encode the training tone information in the training data to obtain the training tone encoded feature. The implementation process may also refer to the relevant records of steps S202 to S204 in the embodiments shown in FIG. 2, which will not be repeated here.

In S603, a target training style encoded feature is extracted by using a style extractor in the speech synthesis model, based on the content information of the training text and the style feature information using the training style corresponding to the training style information to describe the content information of the training text.

It should be noted that the content information of the training text is the same as the content information of the training text input during training of the style encoder. The style feature information using the training style corresponding to the training style information to describe the content information of the training text may be in the form of the Mel spectrum sequence.

Figure 7:
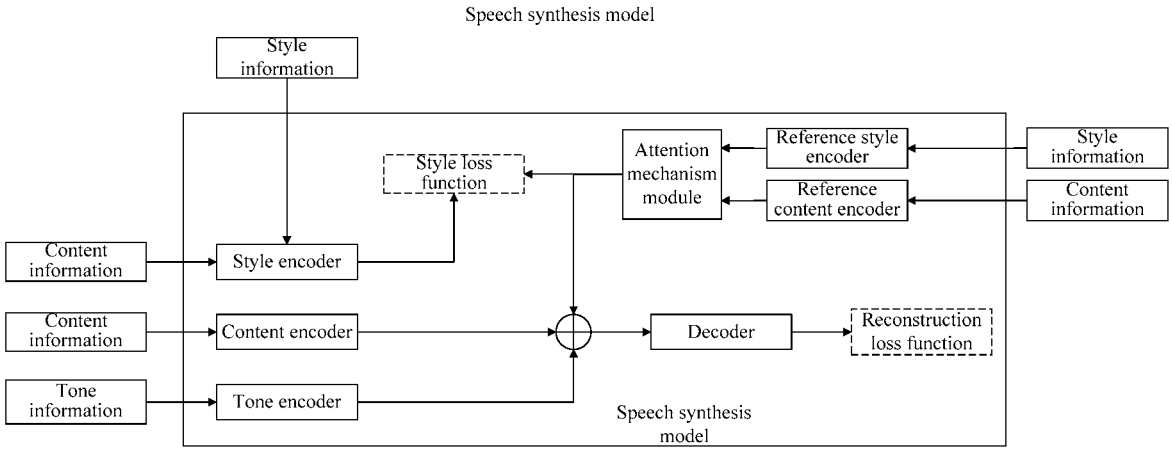
FIG. 7 is a schematic diagram of a training architecture of a speech synthesis model of the embodiments.

FIG. 7 is a schematic diagram of a training architecture of a speech synthesis model in the embodiments. As shown in FIG. 7, compared with the schematic diagram of the application architecture of the speech synthesis model shown in FIG. 3, when the speech synthesis model is trained, a style extractor is added to enhance a training effect. When the speech synthesis model is used, the style extractor is not needed, and the architecture shown in FIG. 3 is directly adopted. As shown in FIG. 7, the style extractor may include a reference style encoder, a reference content encoder, and an attention mechanism module, so as to compress a style vector to a text level, and a target training style encoded feature obtained is a learning goal of the style encoder.

Specifically, in a training phase, the style extractor learns a style expression in an unsupervised manner, and the style expression is also used as a goal of the style encoder to drive the learning of the style encoder. Once the training of the speech synthesis model is completed, the style encoder has a same function as the style extractor. In an application phase, the style encoder may replace the style extractor. Therefore, the style extractor only exists in the training phase. It should be noted that due to a powerful effect of the style extractor, the entire speech synthesis model has a good decoupling performance, that is, each of the content encoder, the style encoder, and the tone encoder perform their own functions respectively, with a clear division of operation. The content encoder is responsible for how to pronounce, the style encoder is responsible for a style of a pronunciation, and the tone encoder is responsible for a tone of the pronunciation.

In S604, a decoding is performed by using a decoder in the speech synthesis model based on the training content encoded feature, the target training style encoded feature, and the training tone encoded feature, so as to generate a predicted acoustic feature information of the training text.

In S605, a comprehensive loss function is constructed based on the training style encoded feature, the target training style encoded feature, the predicted acoustic feature information, and the target acoustic feature information.

For example, when the step S605 is specifically implemented, the following steps may be included. (a) A style loss function is constructed based on the training style encoded feature and the target training style encoded feature. (b) An acoustic feature loss function is constructed based on the predicted acoustic feature information and the target acoustic feature information. (c) The comprehensive loss function is generated based on the style loss function and the reconstruction loss function.

Specifically, a weight may be configured for each of the style loss function and the reconstruction loss function, and a sum of the weighted style loss function and the weighted reconstruction loss function may be taken as a final comprehensive loss function. Specifically, a weight ratio may be set according to actual needs. For example, if the style needs to be emphasized, a relatively large weight may be set for the style. For example, when the weight of the reconstruction loss function is set to 1, the weight of the style loss function may be set to a value between 1 and 10, and the larger the value, the greater a proportion of the style loss function, and the greater an impact of the style on the whole training.

In S606, whether the comprehensive loss function converges or not is determined. If the comprehensive loss function does not converge, the step S607 is executed; and if the comprehensive loss function converges, the step S608 is executed.

In S607, parameters of the content encoder, the style encoder, the tone encoder, the style extractor, and the decoder are adjusted in response to the comprehensive loss function not converging, so that the comprehensive loss function tends to converge. The step S602 is executed to acquire a next training data, and continue training.

In S608, whether the comprehensive loss function always converges during the training of a preset number of consecutive rounds or not is determined. If the comprehensive loss function does not always converges, the step S602 is executed to acquire a next training data, and continue training; and if the comprehensive loss function always converges, parameters of the speech synthesis model are determined, and then the speech synthesis model is determined, and the training ends.

The step S608 may be used as a training termination condition, the preset number of consecutive rounds may be set according to actual experience, such as 100 consecutive rounds, 200 consecutive rounds or other numbers of consecutive rounds. In the preset number of consecutive rounds of training, the comprehensive loss function always converges, indicating that the speech synthesis model has been trained perfectly, and the training may be ended. In addition, optionally, in actual training, the speech synthesis model may also be in a process of infinite convergence, and the speech synthesis model does not absolutely converge in the preset number of consecutive rounds of training. In this case, the training termination condition may be set to a preset number threshold of consecutive rounds of training. When a number of training rounds reaches the preset number threshold of consecutive rounds, the training may be terminated, and when the training is terminated, the parameters of the speech synthesis model are obtained as the final parameters of the speech synthesis model, and the speech synthesis model is used based on the final parameters; otherwise, continue training until the number of training rounds reaches the preset number threshold of consecutive rounds.

The above-mentioned steps S602 to S607 are an implementation manner of step S502 in the embodiments shown in FIG. 5.

Although the embodiments describes each unit in the speech synthesis model during the training process, the training process of the entire speech synthesis model is end-to-end training. In the training of the speech synthesis model, two loss functions are included. One of the two loss functions is the reconstruction loss function constructed based on the output of the decoder; and another of the two loss functions is the style loss function constructed based on the output of the style encoder and the output of the style extractor. The two loss functions may both adopt a loss function of L2 norm.

The method of training the speech synthesis model in the embodiments adopts the above-mentioned technical solutions to effectively ensure the complete decoupling of content, style, and tone during the training process, thereby enabling the trained speech synthesis model to achieve the cross-style, cross-tone, and cross-language speech synthesis, which may enrich the diversity of speech synthesis and reduce the dullness of long-time broadcasting, so as to improve the user's experience.

Figure 8:
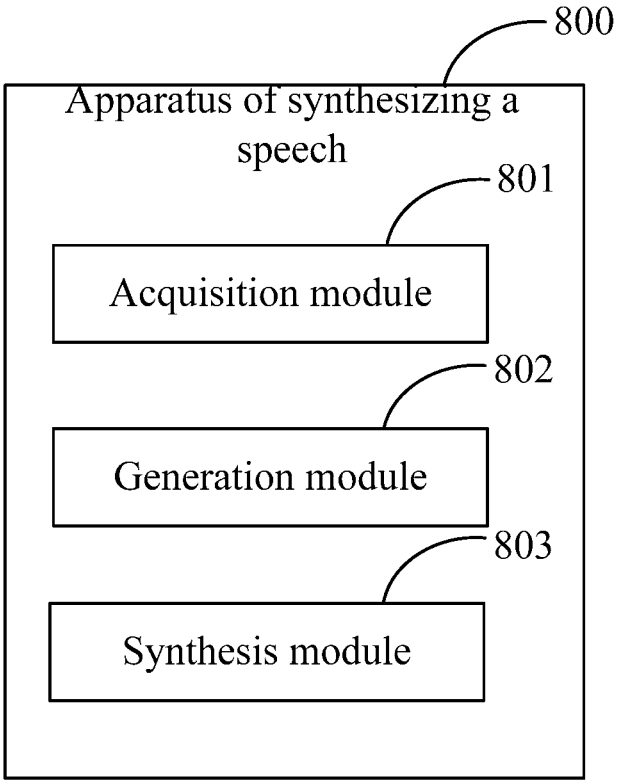
FIG. 8 is a schematic diagram of some embodiments according to the present disclosure.

FIG. 8 is a schematic diagram of some embodiments according to the present disclosure. As shown in FIG. 8, the embodiments provide an apparatus 800 of synthesizing a speech, and the apparatus 800 includes: an acquisition module 801 used to acquire a style information of a speech to be synthesized, a tone information of the speech to be synthesized, and a content information of a text to be processed; a generation module 802 used to generate an acoustic feature information of the text to be processed, by using a pre-trained speech synthesis model, based on the style information, the tone information, and the content information of the text to be processed; and a synthesis module 803 used to synthesize the speech for the text to be processed, based on the acoustic feature information of the text to be processed.

The apparatus 800 of synthesizing a speech in the embodiments uses the above-mentioned modules to realize a realization principle and technical effects of speech synthesis processing, which are the same as the mechanism of the above-mentioned related method embodiments. For details, reference may be made to the related records of the above-mentioned method embodiments, which will not be repeated here.

Figure 9:
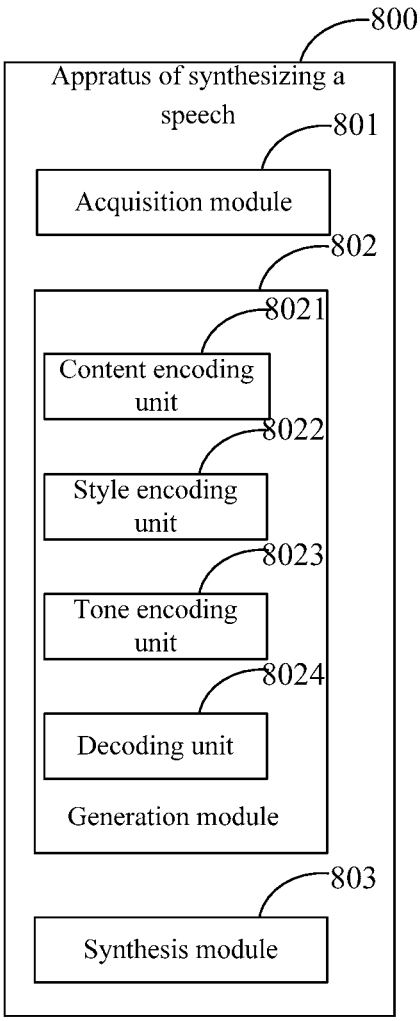
FIG. 9 is a schematic diagram of some embodiments according to the present disclosure.

FIG. 9 is a schematic diagram of some embodiments according to the present disclosure. As shown in FIG. 9, the embodiments provide an apparatus 800 of synthesizing a speech. The apparatus 800 of synthesizing a speech in the embodiments describes the technical solution of the present disclosure in more detail on the basis of the above-mentioned embodiments shown in FIG. 8.

As shown in FIG. 9, the generation module 802 in the apparatus 800 of synthesizing a speech in the embodiments, includes: a content encoding unit 8021 used to encode the content information of the text to be processed, by using a content encoder in the speech synthesis model, so as to obtain a content encoded feature; a style encoding unit 8022 used to encode the content information of the text to be processed and the style information by using a style encoder in the speech synthesis model, so as to obtain a style encoded feature; a tone encoding unit 8023 used to encode the tone information by using a tone encoder in the speech synthesis model, so as to obtain a tone encoded feature; and a decoding unit 8024 used to decode by using a decoder in the speech synthesis model based on the content encoded feature, the style encoded feature, and the tone encoded feature, so as to generate the acoustic feature information of the text to be processed.

Further optionally, the acquisition module 801 in the apparatus 800 of synthesizing a speech in the embodiments is used to acquire a description information of an input style of a user; and determine a style identifier, from a preset style table, corresponding to the input style according to the description information of the input style, as the style information of the speech to be synthesized; or acquire an audio information described in an input style; and extract a tone information of the input style from the audio information, as the style information of the speech to be synthesized.

The apparatus 800 of synthesizing a speech in the embodiments uses the above-mentioned modules to realize a realization principle and technical effects of speech synthesis processing, which are the same as the mechanism of the above-mentioned related method embodiments. For details, reference may be made to the related records of the above-mentioned method embodiments, which will not be repeated here.

Figure 10:
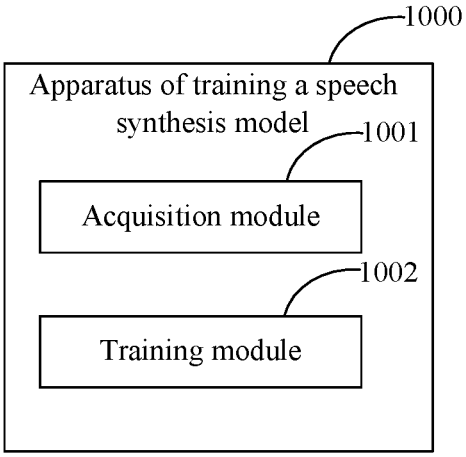
FIG. 10 is a schematic diagram of some embodiments according to the present disclosure.

FIG. 10 is a schematic diagram of some embodiments according to the present disclosure. As shown in FIG. 10, this embodiment provides an apparatus 1000 of training a speech synthesis model, and the apparatus 1000 includes: an acquisition module 1001 used to acquire a plurality of training data, in which each of the plurality of training data contains a training style information of a speech to be synthesized, a training tone information of the speech to be synthesized, a content information of a training text, a style feature information using a training style corresponding to the training style information to describe the content information of the training text, and a target acoustic feature information using the training style corresponding to the training style information and a training tone corresponding to the training tone information to describe the content information of the training text; and a training module 1002 used to train the speech synthesis model by using the plurality of training data.

The apparatus 1000 of training a speech synthesis model in the embodiments uses the above-mentioned modules to realize a realization principle and technical effects of training the speech synthesis model, which are the same as the mechanism of the above-mentioned related method embodiments. For details, reference may be made to the related records of the above-mentioned method embodiments, which will not be repeated here.

Figure 11:
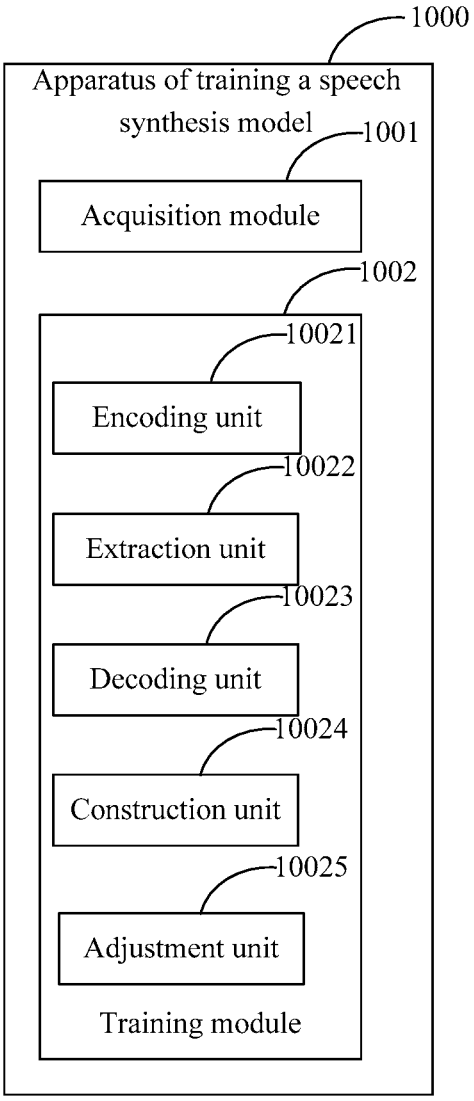
FIG. 11 is a schematic diagram of some embodiments according to the present disclosure.

FIG. 11 is a schematic diagram of some embodiments according to the present disclosure. As shown in FIG. 11, the embodiments provide an apparatus 1000 of training a speech synthesis model. The apparatus 1000 of training a speech synthesis model in the embodiments describes the technical solution of the present disclosure in more detail on the basis of the above-mentioned embodiments shown in FIG. 10.

As shown in FIG. 11, the training module 1002 in the apparatus 1000 of training a speech synthesis model in the embodiments, includes: an encoding unit 10021 used to encode the content information of the training text, the training style information and the training tone information in each of the plurality of training data by using a content encoder, a style encoder, and a tone encoder in the speech synthesis model, respectively, so as to obtain a training content encoded feature, a training style encoded feature, and a training tone encoded feature sequentially; an extraction unit 10022 used to extract a target training style encoded feature by using a style extractor in the speech synthesis model, based on the content information of the training text and the style feature information using the training style corresponding to the training style information to describe the content information of the training text; a decoding unit 10023 used to decode by using a decoder in the speech synthesis model based on the training content encoded feature, the target training style encoded feature, and the training tone encoded feature, so as to generate a predicted acoustic feature information of the training text; a construction unit 10024 used to construct a comprehensive loss function based on the training style encoded feature, the target training style encoded feature, the predicted acoustic feature information, and the target acoustic feature information; and an adjustment unit 10025 used to adjust parameters of the content encoder, the style encoder, the tone encoder, the style extractor, and the decoder in response to the comprehensive loss function not converging, so that the comprehensive loss function tends to converge.

Further optionally, the construction unit 10024 is used to: construct a style loss function based on the training style encoded feature and the target training style encoded feature; construct a reconstruction loss function based on the predicted acoustic feature information and the target acoustic feature information; and generate the comprehensive loss function based on the style loss function and the reconstruction loss function.

The apparatus 1000 of training a speech synthesis model in the embodiments uses the above-mentioned modules to realize a realization principle and technical effects of training the speech synthesis model, which are the same as the mechanism of the above-mentioned related method embodiments. For details, reference may be made to the related records of the above-mentioned method embodiments, which will not be repeated here.

According to the embodiments of the present disclosure, the present disclosure further provides an electronic device and a readable storage medium.

Figure 12:
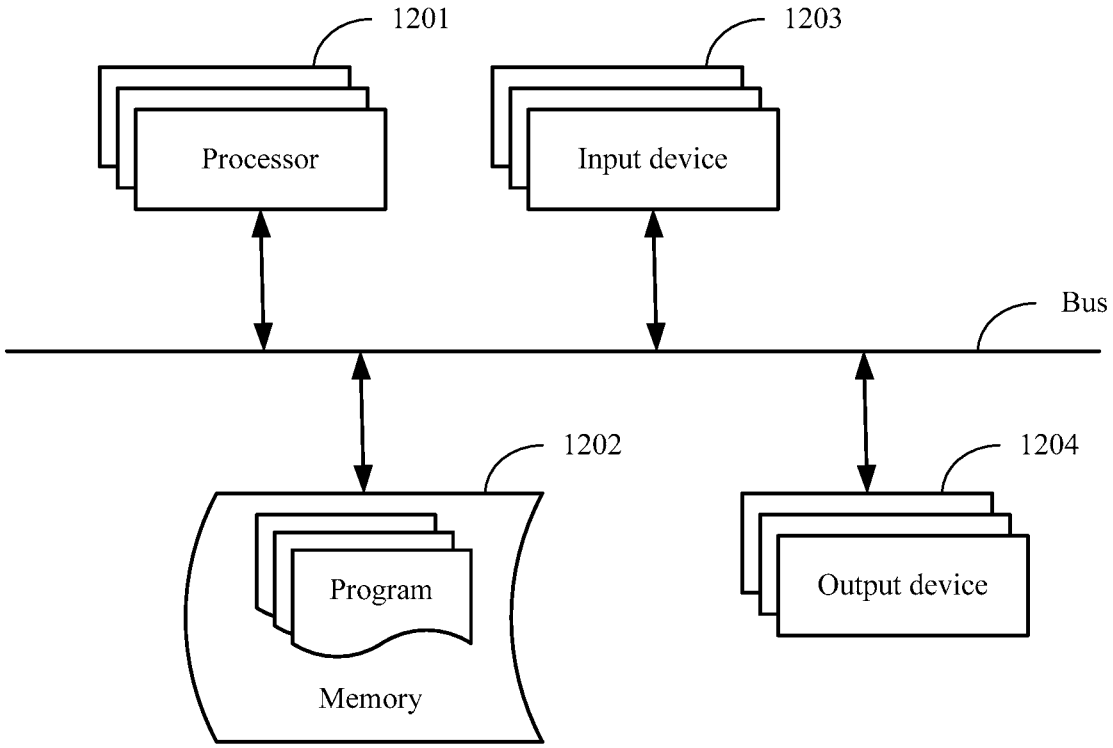
FIG. 12 is a block diagram of an electronic device for implementing the above-mentioned method according to the embodiments of the present disclosure.

FIG. 12 shows a block diagram of an electronic device implementing the methods described above. The electronic device is intended to represent various forms of digital computers, such as a laptop computer, a desktop computer, a workstation, a personal digital assistant, a server, a blade server, a mainframe computer, and other suitable computers. The electronic device may further represent various forms of mobile devices, such as a personal digital assistant, a cellular phone, a smart phone, a wearable device, and other similar computing devices. The components, connections and relationships between the components, and functions of the components in the present disclosure are merely examples, and are not intended to limit the implementation of the present disclosure described and/or required herein.

As shown in FIG. 12, the electronic device may include one or more processors 1201, a memory 1202, and interface (s) for connecting various components, including high-speed interface(s) and low-speed interface(s). The various components are connected to each other by using different buses, and may be installed on a common motherboard or installed in other manners as required. The processor may process instructions executed in the electronic device, including instructions stored in or on the memory to display graphical information of GUI (Graphical User Interface) on an external input/output device (such as a display device coupled to an interface). In other embodiments, a plurality of processors and/or a plurality of buses may be used with a plurality of memories, if necessary. Similarly, a plurality of electronic devices may be connected in such a manner that each device provides a part of necessary operations (for example, as a server array, a group of blade servers, or a multi-processor system). In FIG. 12, a processor 1201 is illustrated by way of an example.

The memory 1202 is a non-transitory computer-readable storage medium provided by the present disclosure. The memory stores instructions executable by at least one processor, so that the at least one processor executes the method of synthesizing a speech and the method of training a speech synthesis model provided by the present disclosure. The non-transitory computer-readable storage medium of the present disclosure stores computer instructions for allowing a computer to execute the method of synthesizing a speech and the method of training a speech synthesis model provided by the present disclosure.

The memory 1202, as a non-transitory computer-readable storage medium, may be used to store non-transitory software programs, non-transitory computer-executable programs and modules, such as program instructions/modules corresponding to the method of synthesizing a speech and the method of training a speech synthesis model in the embodiments of the present disclosure (for example, the modules shown in the FIGS. 8, 9, 10 and 11). The processor 1201 executes various functional applications and data processing of the server by executing the non-transient software programs, instructions and modules stored in the memory 1202, thereby implementing the method of synthesizing a speech and the method of training a speech synthesis model in the method embodiments described above.

The memory 1202 may include a program storage area and a data storage area. The program storage area may store an operating system and an application program required by at least one function. The data storage area may store data etc. generated according to the using of the electronic device implementing the method of synthesizing a speech and the method of training a speech synthesis model. In addition, the memory 1202 may include a high-speed random access memory, and may further include a non-transitory memory, such as at least one magnetic disk storage device, a flash memory device, or other non-transitory solid-state storage devices. In some embodiments, the memory 1202 may optionally include a memory provided remotely with respect to the processor 1201, and such remote memory may be connected through a network to the electronic device implementing the method of synthesizing a speech and the method of training a speech synthesis model. Examples of the above-mentioned network include, but are not limited to the internet, intranet, local area network, mobile communication network, and combination thereof.

The electronic device implementing the method of synthesizing a speech and the method of training a speech synthesis model may further include an input device 1203 and an output device 1204. The processor 1201, the memory 1202, the input device 1203 and the output device 1204 may be connected by a bus or in other manners. In FIG. 12, the connection by a bus is illustrated by way of an example.

The input device 1203 may receive an input number or character information, and generate key input signals related to user settings and function control of the electronic device implementing the method of synthesizing a speech and the method of training a speech synthesis model, and the input device 1203 may be such as a touch screen, a keypad, a mouse, a track pad, a touchpad, a pointing stick, one or more mouse buttons, a trackball, a joystick, and so on. The output device 1204 may include a display device, an auxiliary lighting device (for example, LED), a tactile feedback device (for example, a vibration motor), and the like. The display device may include, but is not limited to, a liquid crystal display (LCD), a light emitting diode (LED) display, and a plasma display. In some embodiments, the display device may be a touch screen.

Various embodiments of the systems and technologies described herein may be implemented in a digital electronic circuit system, an integrated circuit system, an application specific integrated circuit (ASIC), a computer hardware, firmware, software, and/or combinations thereof. These various embodiments may be implemented by one or more computer programs executable and/or interpretable on a programmable system including at least one programmable processor. The programmable processor may be a dedicated or general-purpose programmable processor, which may receive data and instructions from the storage system, the at least one input device and the at least one output device, and may transmit the data and instructions to the storage system, the at least one input device, and the at least one output device.

These computing programs (also referred to as programs, software, software applications, or codes) contain machine instructions for a programmable processor, and may be implemented using high-level programming languages, object-oriented programming languages, and/or assembly/machine languages. As used herein, the terms "machine-readable medium" and "computer-readable medium" refer to any computer program product, apparatus and/or device (for example, a magnetic disk, an optical disk, a memory, a programmable logic device (PLD)) for providing machine instructions and/or data to a programmable processor, including a machine-readable medium for receiving machine instructions as machine-readable signals. The term "machine-readable signal" refers to any signal for providing machine instructions and/or data to a programmable processor.

In order to provide interaction with the user, the systems and technologies described here may be implemented on a computer including a display device (for example, a CRT (cathode ray tube) or LCD (liquid crystal display) monitor) for displaying information to the user, and a keyboard and a pointing device (for example, a mouse or a trackball) through which the user may provide the input to the computer. Other types of devices may also be used to provide interaction with users. For example, a feedback provided to the user may be any form of sensory feedback (for example, a visual feedback, an auditory feedback, or a tactile feedback), and the input from the user may be received in any form (including an acoustic input, a voice input or a tactile input).

The systems and technologies described herein may be implemented in a computing system including back-end components (for example, a data server), or a computing system including middleware components (for example, an application server), or a computing system including front-end components (for example, a user computer having a graphical user interface or web browser through which the user may interact with the implementation of the systems and technologies described herein), or a computing system including any combination of such back-end components, middleware components or front-end components. The components of the system may be connected to each other by digital data communication (for example, a communication network) in any form or through any medium. Examples of the communication network include a local area network (LAN), a wide area network (WAN), internet and a blockchain network.

The computer system may include a client and a server. The client and the server are generally far away from each other and usually interact through a communication network. The relationship between the client and the server is generated through computer programs running on the corresponding computers and having a client-server relationship with each other. The server may be a cloud server, also known as a cloud computing server or a cloud host, and the server is a host product in the cloud computing service system to solve shortcomings of difficult management and weak business scalability in conventional physical host and VPS services ("Virtual Private Server" or "VPS" for short).

According to the technical solutions of the embodiments of the present disclosure, the style information of the speech to be synthesized, the tone information of the speech to be synthesized, and the content information of the text to be processed are acquired. The acoustic feature information of the text to be processed is generated by using the pre-trained speech synthesis model based on the style information, the tone information, and the content information of the text to be processed. The speech for the text to be processed is synthesized based on the acoustic feature information of the text to be processed. In this manner, a cross-language, cross-style, and cross-tone speech synthesis may be performed, which may enrich the diversity of speech synthesis and improve the user's experience.

According to the technical solutions of the embodiments of the present disclosure, the cross-language, cross-style, and cross-tone speech synthesis may be performed by adopting the above-mentioned technical solutions, which may enrich the diversity of speech synthesis and reduce the dullness of long-time broadcasting, so as to improve the user's experience. The technical solutions of the embodiments of the present disclosure may be applied to various speech interaction scenarios, and has a universal promotion.

According to the technical solutions of the embodiments of the present disclosure, it is possible to effectively train the speech synthesis model by adopting the above-mentioned technical solutions, so that the speech synthesis model learns the process of synthesizing a speech according to the content, the style and the tone, based on the training data, and thus the learned speech synthesis model may enrich the diversity of speech synthesis.

According to the technical solutions of the embodiments of the present disclosure, it is possible to effectively ensure the complete decoupling of content, style, and tone during the training process by adopting the above-mentioned technical solutions, thereby enabling the trained speech synthesis model to achieve the cross-style, cross-tone, and cross-language speech synthesis, which may enrich the diversity of speech synthesis and reduce the dullness of long-time broadcasting, so as to improve the user's experience.

It should be understood that steps of the processes illustrated above may be reordered, added or deleted in various manners. For example, the steps described in the present disclosure may be performed in parallel, sequentially, or in a different order, as long as a desired result of the technical solution of the present disclosure may be achieved. This is not limited in the present disclosure.

The above-mentioned specific embodiments do not constitute a limitation on the scope of protection of the present disclosure. Those skilled in the art should understand that various modifications, combinations, sub-combinations and substitutions may be made according to design requirements and other factors. Any modifications, equivalent replacements and improvements made within the spirit and principles of the present disclosure shall be contained in the scope of protection of the present disclosure.

The invention claimed is:

1. A method of synthesizing a speech, comprising:

acquiring a style information of a speech to be synthesized, a tone information of the speech to be synthesized, and a content information of a text to be processed;

generating an acoustic feature information of the text to be processed, by using a pre-trained speech synthesis model, based on the style information, the tone information, and the content information of the text to be processed; and synthesizing the speech for the text to be processed, based on the acoustic feature information of the text to be processed, wherein the acquiring the style information of the speech to be synthesized comprises:

acquiring a description information of an input style of a user; and determining a style identifier, from a preset style table, corresponding to the input style according to the description information of the input style, as the style information of the speech to be synthesized.

2. The method according to claim 1, wherein the generating an acoustic feature information of the text to be processed, by using a pre-trained speech synthesis model, based on the style information, the tone information, and the content information of the text to be processed comprising:

encoding the content information of the text to be processed, by using a content encoder in the speech synthesis model, so as to obtain a content encoded feature;

encoding the content information of the text to be processed and the style information by using a style encoder in the speech synthesis model, so as to obtain a style encoded feature;

encoding the tone information by using a tone encoder in the speech synthesis model, so as to obtain a tone encoded feature; and decoding by using a decoder in the speech synthesis model based on the content encoded feature, the style encoded feature, and the tone encoded feature, so as to generate the acoustic feature information of the text to be processed.

3. An electronic device, comprising:

at least one processor; and a memory in communication with the at least one processor;

wherein the memory stores instructions executable by the at least one processor, and the instructions, when executed by the at least one processor, cause the at least one processor to implement the method according to claim 1.

4. A non-transitory computer-readable storage medium having computer instructions stored thereon, wherein the computer instructions, when executed, cause a computer to implement the method according to claim 1.

5. The method according to claim 1, wherein the acquiring the style information of the speech to be synthesized further comprises:

acquiring an audio information described in an input style; and extracting a tone information of the input style from the audio information, as the style information of the speech to be synthesized.

6. A method of training a speech synthesis model, comprising:

acquiring a plurality of training data, wherein each of the plurality of training data contains a training style information of a speech to be synthesized, a training tone information of the speech to be synthesized, a content information of a training text, a style feature information using a training style corresponding to the training style information to describe the content information of the training text, and a target acoustic feature information using the training style corresponding to the training style information and a training tone corresponding to the training tone information to describe the content information of the training text; and training the speech synthesis model by using the plurality of training data.

7. The method according to claim 6, wherein the training the speech synthesis model by using the plurality of training data comprises:

encoding the content information of the training text, the training style information and the training tone information in each of the plurality of training data by using a content encoder, a style encoder, and a tone encoder in the speech synthesis model, respectively, so as to obtain a training content encoded feature, a training style encoded feature, and a training tone encoded feature sequentially;

extracting a target training style encoded feature by using a style extractor in the speech synthesis model, based on the content information of the training text and the style feature information using the training style corresponding to the training style information to describe the content information of the training text;

decoding by using a decoder in the speech synthesis model based on the training content encoded feature, the target training style encoded feature, and the training tone encoded feature, so as to generate a predicted acoustic feature information of the training text;

constructing a comprehensive loss function based on the training style encoded feature, the target training style encoded feature, the predicted acoustic feature information, and the target acoustic feature information; and adjusting parameters of the content encoder, the style encoder, the tone encoder, the style extractor, and the decoder in response to the comprehensive loss function not converging, so that the comprehensive loss function tends to converge.

8. The method according to claim 7, wherein constructing the comprehensive loss function based on the training style encoded feature, the target training style encoded feature, the predicted acoustic feature information, and the target acoustic feature information comprises:

constructing a style loss function based on the training style encoded feature and the target training style encoded feature;

constructing a reconstruction loss function based on the predicted acoustic feature information and the target acoustic feature information; and generating the comprehensive loss function based on the style loss function and the reconstruction loss function.

9. An electronic device, comprising:

at least one processor; and a memory in communication with the at least one processor;

wherein the memory stores instructions executable by the at least one processor, and the instructions, when executed by the at least one processor, cause the at least one processor to implement the method according to claim 6.

10. A non-transitory computer-readable storage medium having computer instructions stored thereon, wherein the computer instructions, when executed, cause a computer to implement the method according to claim 6.

* * * * *